US005188326A

United States Patent [19]

Zich

[11] Patent Number: 5,188,326

[45] Date of Patent: Feb. 23, 1993

[54] ADJUSTABLE ADAPTER BRACKET

[75] Inventor: Jerrold R. Zich, Hoffman Estates, Ill.

[73] Assignee: Colony, Incorporated, Hanover Park, Ill.

[21] Appl. No.: 638,315

[22] Filed: Jan. 4, 1991

[51] Int. Cl.[5] ..... A47B 96/00

[52] U.S. Cl. ..... 248/225.2; 248/222.1

[58] Field of Search ..... 248/225.2, 220.2, 220.3, 248/220.4, 221.2, 222.1, 224.4

[56] References Cited

U.S. PATENT DOCUMENTS

| | | | |
|---|---|---|---|
| 2,060,760 | 11/1936 | Keil | 248/222.1 |
| 2,098,997 | 11/1937 | Bramming | 248/222.1 |
| 4,101,231 | 7/1978 | Streib | 248/272.1 |

FOREIGN PATENT DOCUMENTS

| | | | |
|---|---|---|---|
| 476151 | 1/1974 | Australia | 248/225.2 |
| 2820085 | 11/1979 | Fed. Rep. of Germany | 248/225.2 |
| 2344252 | 10/1077 | France | 248/225.2 |
| 578689 | 1/1958 | Italy | 248/222.1 |
| 983392 | 2/1965 | United Kingdom | 248/222.1 |

*Primary Examiner*—David L. Talbott

*Attorney, Agent, or Firm*—Dressler, Goldsmith, Shore, Sutker & Milnamow, Ltd.

[57] ABSTRACT

An adjustable adapter bracket is provided for use with an apertured support member. The bracket provides support at a selected elevation on the support member for shelving, display components, and the like. The adapter bracket includes a body that defines a load bearing region on which a portion of the shelf or display component rests. A hook element is carried by the body and is movable relative to the body to project beyond the body for entering into one of the apertures and engaging the support member. A nut is provided for cooperating with the body and hook element for adjusting the orientation and amount of projection of the hook element relative to the body.

4 Claims, 1 Drawing Sheet

ADJUSTABLE ADAPTER BRACKET

TECHNICAL FIELD

This invention relates to support apparatus such as shelving, display stands, store fixtures, and the like. More particularly, the invention relates to a bracket for mounting shelves, racks, display units and similar components to a conventional support member, such as a standard, post, upright, or column in a shelving support frame, display stand, or similar support apparatus. The bracket is particularly well suited for mounting point of purchase display units or point of sale display units to an upright.

BACKGROUND OF THE INVENTION AND TECHNICAL PROBLEMS POSED BY THE PRIOR ART

Retail stores typically display or store products on various kinds of support systems, such as point of purchase display units, point of sale display units, display stands, shelving systems, or similar fixtures. There are a variety of such systems suitable for supporting particular types of shelving or point of purchase display components, and the designs of these components may include constructions of wire, heavier steel members, thermoplastic materials, wood, particle board, cardboard, etc.

Many such fixtures and other support apparatus incorporate a plurality of vertically spaced-apart slots in posts, standards, uprights, or columns of the apparatus. Different manufacturers employ slightly different slot designs, configurations, or sizes. Thus, a shelf, rack, or other display component that is intended for being mounted to the support apparatus of one manufacturer may not be readily mounted in another manufacturer's support apparatus.

There is a need among users of such support apparatus, especially retail store users, for a means that will allow shelves and display components of one manufacturer to be used with the support apparatus of another manufacturer. This need may be most acute in retail establishments that have accumulated a number of different display or shelving systems provided by a variety of manufacturers. This need is also especially acute with respect to retail establishments that may have long been using a particular shelving system or display system which is now no longer produced.

Thus, it would be desirable to provide a mechanism for accommodating the mounting of components of one design to a support apparatus of another design.

Further, it would be beneficial if such a mechanism could be adjusted to accommodate various mounting orientations.

Also, it would be advantageous if such a mechanism could be relatively easily installed without the need for special tools.

Finally, such a mechanism should preferably incorporate a design that could be manufactured relatively inexpensively and without requiring critical or close tolerances.

SUMMARY OF THE INVENTION

An adjustable adapter bracket is provided with a novel construction that is suitable for use with an apertured support member. The bracket provides support at a selected elevation on the support member for shelving, display components, and the like.

The adapter bracket includes a body that defines a load bearing region on which a portion of the shelf or display component rests.

A hook means is carried by the body and is moveable relative to the body to project beyond the body for entering into one of the apertures and engaging the support member.

An adjustment means is provided for cooperating with the body and hook means for adjusting the orientation and amount of projection of the hook means relative to the body.

In a preferred embodiment, the body defines a pair of spaced-apart guide ways for each receiving one of two hook means. The hook means includes two, spaced-apart, L-shaped hook elements. Each hook element has a mounting leg portion carried in the body and a foot portion extending generally transversely from the leg portion. The foot portion is received in the support member aperture and engages a portion of the support member adjacent the aperture.

The hook means also includes a shank extending from the leg portion. The shank is threaded and is received in a nut which can be turned on the shank to engage a portion of the body and draw the leg portion toward the body to thereby tighten the engagement between the leg portion and the support member. The hook element is movable relative to the body for initially accommodating the lengthwise positioning of the leg portion to extend a selected distance beyond the body whereby a desired spacing of the foot from the body is obtained so as to accommodate the dimensions of the particular support member.

The hook element is also rotationally adjustable about its lengthwise axis so as to permit the positioning of the leg portion at a selected orientation for accommodating the particular configuration of the support member and support member aperture.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, and the scope of the invention will be pointed out in the appended claims.

For ease of description, the bracket of this invention is described in one particular operating position, and terms such as upper, lower, horizontal, etc., are used with reference to this position. It will be understood, however, that the bracket of this invention may be manufactured, stored, transported, used, and sold in an orientation other than the position described.

The adapter bracket of this invention permits a variety of shelving and display components to be mounted to various kinds of apertured support systems, such as shelving system frames, fixture frames, and the like. The bracket is especially suitable for mounting point of purchase (sale) display units to conventional upright support members.

The bracket permits a shelf or display component of one manufacture to be mounted to a support system of another manufacture.

The bracket can be adjusted to accommodate various configurations of components and support system apparatus. The bracket also permits adjustment in a number of different orientations as may be required in some applications. The bracket can be easily installed and requires no tools.

Figure 1:
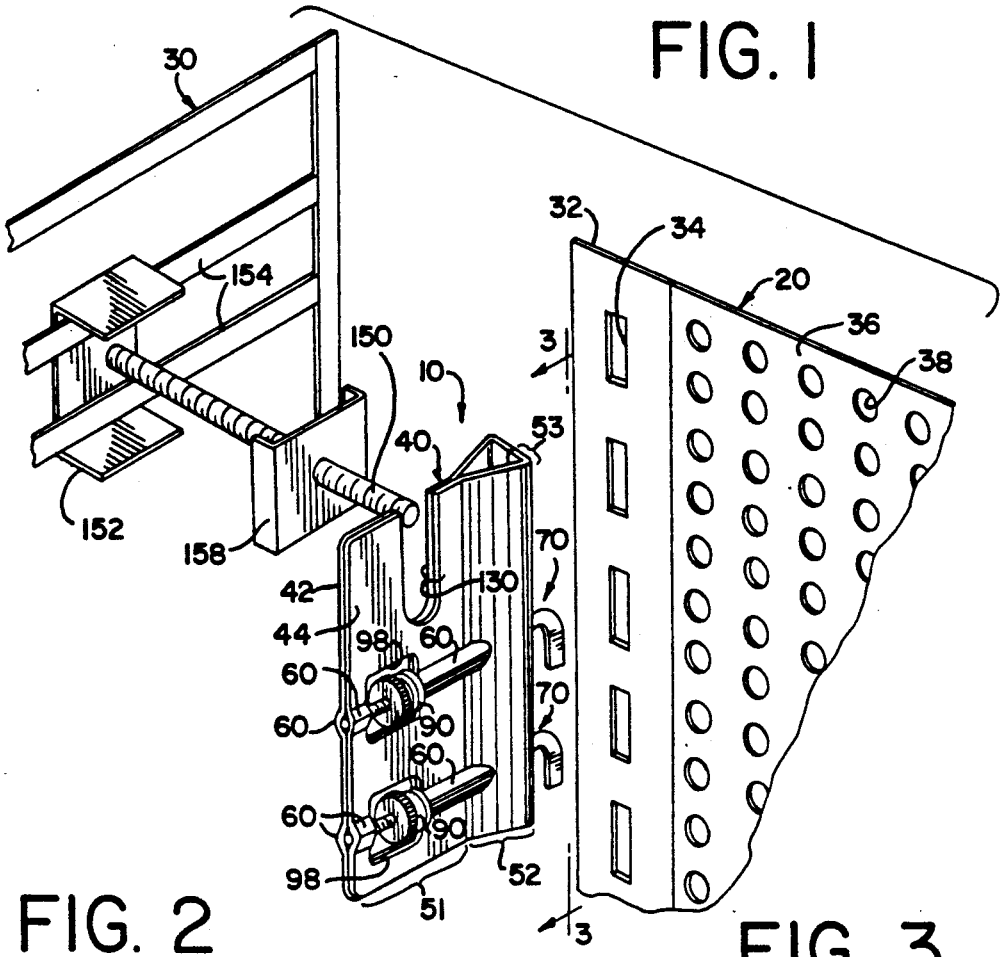
FIG. 1 is a fragmentary, exploded, perspective view of the adjustable adapter bracket of the present invention shown in use with a display rack to be mounted to a support member of a pegboard display fixture.

The bracket is illustrated in FIG. 1, and it is designated generally therein by the reference numeral 10. The bracket 10 is illustrated as being employed with a fixture or support system 20 to support a flat wire display rack 30.

The fixture 20 includes a support member 32 which may be a post, standard, upright, column, or similar structure resting upon, and extending upwardly from, the floor (not illustrated). Alternatively, the support member 32 may be merely a small insert member in the fixture 20 that is carried by other members (not illustrated) at a particular elevation and in a particular orientation for receiving and supporting displays or other components (e.g., intermediate connectors).

The support member 32 is typically provided with a plurality of slots 34. In the illustrated support member 32, the slots 34 are uniformly spaced apart in one vertically aligned row. The shelves or display components, or connectors associated therewith, are typically inserted in the apertures 34 to support the shelves or display components at the selected elevations.

The fixture 20 may also include other components, such as, for example, a pegboard 36 which defines a plurality of apertures 38. The fixture 20 may be conventionally characterized by some manufacturers as a gondola or shelf unit.

Typically, the shape and arrangement of the slots 34, as well as the configuration, size, and thickness of the support member 32, are designed to receive and support a specific shelf or display component (or connector therefor). In many cases, a shelf or display component of one manufacturer cannot be properly received and supported a support member of another manufacturer. The novel bracket 10 of the present invention can overcome that problem in many installations.

The bracket 10 includes a body 40. In the preferred embodiment illustrated, the body 40 comprises two mating body sections 42 and 44 that have mirror image symmetry and that are connected together (as by spot welding) along the plane of symmetry.

Each section 42 and 44 is of unitary construction and includes a generally planar first wall 51, a generally planar second wall 52 which extends from the first wall 51 at an oblique angle, and a generally planar third wall 53 which extends from the second wall 52 in an orientation generally perpendicular to the first wall 51. Each section has outwardly deformed portions which cooperate to define guide ways 60 for receiving hook means 70. Each guide way 60 is an enclosed passage with open ends. Preferably, each guide way 60 is large enough to permit some vertical movement of the hook means 70.

The hook means 70 is carried by the body 40 and is movable relative to the body 40 to project sufficiently beyond the body 40 for entering into the apertures 34 and for engaging the support member 32 adjacent the apertures.

In the preferred embodiment illustrated, the hook means 70 includes two, spaced-apart, L-shaped hook elements each having a leg portion 72 carried in the body 40 and a foot portion 76 extending generally transversely from the leg portion 72. Preferably, the hook element leg portion 72 and the hook element foot portion 76 each have a generally rectangular cross section.

Figure 2:
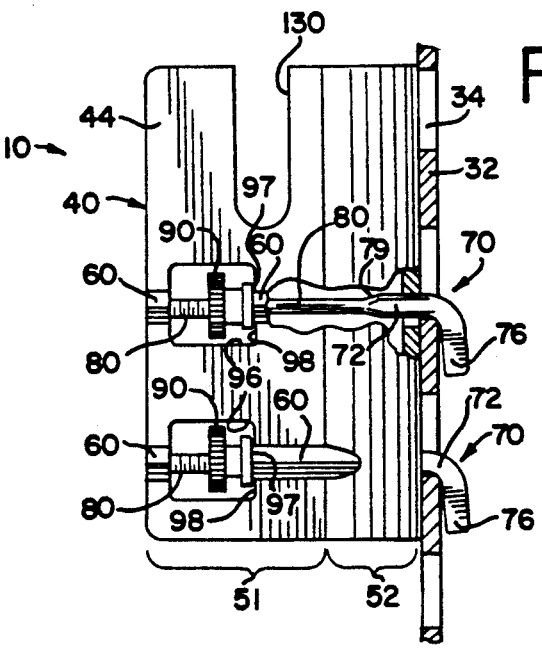
FIG. 2 is an enlarged, fragmentary, cross-sectional view of the bracket of the present invention installed on the support member, and a portion of the bracket has been cut away to illustrate interior detail.

The hook means 70 further includes a shank 80 extending from the leg portion 72 of each hook element. There is a transition section 79 (FIG. 2) at which the rectangular cross section of the leg portion 72 merges with the generally cylindrical configuration of the shank 80. At least a portion of the shank 80 is threaded for receiving, and threadingly engaging, a nut 90.

Each nut 90 is accommodated in a cavity 96 defined by the body 40. Each cavity 96 interrupts a guide way 60 to divide the guide way 60 into two portions—one portion on each side of the cavity 96. One end of each cavity 96 is defined by a bearing surface 98 on the body 40, and each nut 90 has a facing engaging surface 97 for engaging the body bearing surface 98.

Figure 4:
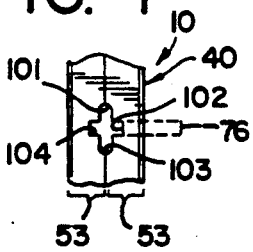
FIG. 4 is a fragmentary view similar to FIG. 3, but with the hook elements omitted to illustrate underlying detail and with an alternate position of a hook element illustrated in phantom by the use of dashed lines.

Each hook element leg portion 72 extends through the third wall 53 of each of the bracket body sections 42 and 44. To accommodate adjustment of the hook element orientation and projection relative to the bracket body 40, the walls 53 of the body 40 define four intersecting slots 101, 102, 103, and 104 (FIG. 4). The slots form a generally cruciform opening.

Figure 3:
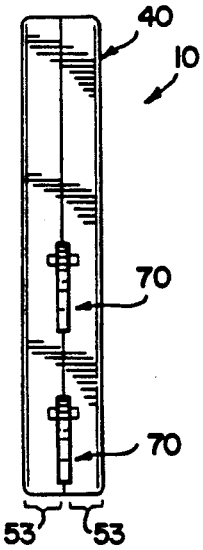
FIG. 3 is a view of the bracket taken generally along the plane 3—3 in FIG. 1.

The generally rectangular cross section leg portion 72 of the hook element can be aligned in a selected one of these slots to accommodate a desired orientation of the bracket 10 and/or foot portion 76 relative to various orientations of slots 34 in the receiving support member 32. FIG. 3 illustrates the hook elements of the hook means 70 oriented so that each leg portion 72 is engaged in the upper, vertical slot 101 (visible in FIG. 4).

If desired, the leg portion 72 of each hook means 70 may be oriented in the other slots, such as in the slot 102 as illustrated in phantom in FIG. 4. To accommodate the change in orientation of the leg portion 72, the nut 90 may have to be backed off sufficiently from the body bearing surface 98 to permit the leg portion 72 to be pulled outwardly of the body walls 53 sufficiently far enough to locate the narrower shank 80 at the center of the slots 101, 102, 103, and 104 so that the shank 80 can be rotated to align the foot portion 76 in the desired orientation.

After the leg portion 72 is disposed in a selected orientation in one of the slots 101, 102, 103, or 104, the foot portion 76 can then be inserted in a receiving aperture 34 of the support member 32. The nut 90 is rotated on the shank 80 to back the nut 90 away from the body bearing surface 98 by an amount sufficient to permit a lengthwise positioning of the leg portion 72 in the guide way 60. The leg portion 72 is then positioned so that it extends a selected distance beyond the body walls 53. In this manner a desired spacing of the foot portion 76 from the wall 73 is obtained, and the thickness of the support member 32 is accommodated.

After the foot portion 76 is properly seated within the support member aperture 34, the nut 90 is turned on the shank 80 to move the nut 90 toward the hook element and against the body bearing surface 98. This draws the hook element foot portion 76 toward the bracket body 40 and effects a tightening of the engagement of the foot portion 76 with the support member 32.

After the bracket 10 has been properly installed on the support member 32, it is ready to be engaged with a shelf, display unit, or attachment component therefor. To this end, the bracket 10 is provided with a load bearing region in the form of an upwardly open notch or channel 130. The notch 130 is adapted to receive an attachment member, such as a screw 50 projecting from a C-shaped clamp member 152 that is engaged with wires 154 of the display rack 30. A second clamp member 158 would typically be slidably disposed on the screw 150 for being tightened against the other side of the display rack wires 154. The screw 150 is positioned in the bracket notch 130 so as to locate the clamping member 158 adjacent the bracket section 42, and a nut (not illustrated) may be threaded on the nut 150 to hold the screw 150, clamps 158 and 152, and display rack 30 on the bracket 10.

The screw 150, clamp member 152, and clamp member 158 have an appropriate design and configuration for accommodating the design of the particular display rack 30, and such components are typically furnished with the display rack 30.

Other types of racks may incorporate different clamp attachment structures having a projecting portion or portions for being received in the bracket channel 130. Racks, shelves, or other components to be supported may include other engagement members that can be supported on or retained in the notch 130.

The bracket 10 may be employed to support shelving or display rack components in other ways. To this end, other portions of the bracket body 40 may be regarded as load bearing regions for supporting such components. For example, the top edge of the bracket 10, on either side of the notch 130, may be used as a load bearing region to support components. Alternatively, by reorienting the bracket 10 relative to the hook means 70, the bracket 10 may be disposed 90 degrees from the orientation illustrated in FIGS. 1–4. Then the surface of the body section 42 (or 44, depending upon which side is "up") may function as a load bearing region for supporting components.

In some applications, it may be desireable to provide certain modifications to the bracket 10. For example, additional notches or special apertures could be provided in the body 40 for receiving attachment members of shelves or display components.

It will be appreciated that novel structure of the bracket 10 accommodates variations in orientation and spacing of the support member apertures 34. Also, it is possible to use the bracket 10 with very small apertures 34. To facilitate assembly in such a situation, the hook element of each hook means 70 could be initially removed from the bracket body 40 and inserted separately into the apertures 34. Then the bracket body 40 could be slid partially onto the hook means 70. Next the nuts 90 could be installed and tightened as necessary.

In some applications, the adjustment capability of the bracket need not be as great as that which has been described. For example, in some situations, the slots 102 and 104 (FIG. 4) could be omitted.

The adjustable adapter bracket 10 of the present invention is relatively easy to use, and requires no tools for installation. It accommodates the mounting of shelf components or display components of one design to a support apparatus of another design. It permits the bracket components to be arranged in a number of different relative orientations. The bracket can be relatively inexpensively manufactured and does not require unusually close or critical tolerances.

It will be readily observed from the foregoing detailed description of the invention and from the illustrations thereof that numerous variations and modifications may be effected without departing from the true spirit and scope of the novel concepts or principles of this invention.

What is claimed is:

1. An adjustable adapter bracket suitable for providing support at a selected elevation on a support member defining apertures, said adjustable adapter bracket comprising:

a body defining a load bearing region;

hook means carried by said body and movable relative to said body to project beyond said body for entering into one of said apertures and engaging said support member; and adjustment means cooperating with said body and hook means for adjusting the orientation and amount of projection of said hook means relative to said body;

said body comprising two mating body sections that have mirror image symmetry and that are connected together along a plane of symmetry;

each said section being of unitary construction and including: (a) a generally planar first wall, (b) a generally planar second wall extending from said first wall at an oblique angle, and (c) a generally planar third wall extending from said second wall in an orientation generally perpendicular to said first wall;

each said third wall defining a flat engagement surface for engaging said support member adjacent said apertures; and said hook means including a hook element projecting from said third wall engagement surface of each said body section.

2. An adjustable adapter bracket suitable for providing support at a selected elevation on a support member defining apertures, said adjustable adapter bracket comprising:

a body defining a load bearing region;

hook means carried by said body and movable relative to said body to project beyond said body for entering into one of said apertures and engaging said support member; and adjustment means cooperating with said body and hook means for adjusting the orientation and amount of projection of said hook means relative to said body;

said body having a wall defining an engagement surface for engaging said support member adjacent said apertures;

said wall defining four intersecting slots forming a generally cruciform opening through said wall; and said hook means including a hook element comprising a leg portion and a foot portion extending from said leg portion to define a generally L-shaped configuration, said leg portion having a generally rectangular transverse cross section for being received in a selected one of said four slots to orient said hook element in a selected one of four orientations, said foot portion having a generally rectangular transverse cross section for being received in one of said support member apertures and engaging said support member adjacent said aperture, said hook element being movable relative to said wall for accommodating the lengthwise positioning of said leg portion to extend a selected distance beyond a said wall whereby a desired spacing of said foot portion from said wall is obtained.

3. The bracket in accordance with claim 2 in which said load bearing region includes a notch defined by said body for receiving a cantilevered mounting member.

4. The bracket in accordance with claim 2 in which said hook means further includes a shank extending from said leg portion;

said adjustment means includes threads on said shank and a nut threadingly engaged with said shank threads;

said body defines a bearing surface; and said nut defines an engaging surface for bearing against said body bearing surface as said nut is threaded on said shank toward said hook element to thereby draw said hook element foot portion toward said body and tighten the engagement of said foot portion with said support member.

* * * * *